US005582098A

United States Patent [19]

Clinton

[11] Patent Number: 5,582,098

[45] Date of Patent: Dec. 10, 1996

[54] CARDBOARD COLLECTOR AND COMPACTOR

[76] Inventor: Kenneth M. Clinton, 621 Casey Key Rd., Nokomis, Fla. 34275

[21] Appl. No.: 541,335

[22] Filed: Oct. 10, 1995

[51] Int. Cl.[6] ..... B65B 13/20

[52] U.S. Cl. ..... 100/34; 100/219; 100/233; 100/912; 242/168; 242/613.2

[58] Field of Search ..... 100/34, 78, 212, 100/219, 233, 912; 242/168, 169, 537, 604, 613.2, 613.3

[56] References Cited

U.S. PATENT DOCUMENTS

| | | | |
|---|---|---|---|
| 385,126 | 6/1888 | Leupold | 100/34 |
| 565,668 | 8/1896 | Binkley | 100/219 |
| 594,487 | 11/1897 | Nugent | 100/34 |
| 859,494 | 7/1907 | Hardesty | 100/233 |
| 944,929 | 12/1909 | Westwood | 100/34 |
| 1,402,433 | 1/1922 | Monroe | 100/233 |
| 1,879,550 | 9/1932 | Shields | 100/233 |
| 2,029,427 | 2/1936 | Klau | 242/537 |
| 3,430,555 | 3/1969 | De Bruhl | 100/34 |
| 3,565,365 | 2/1971 | Newman | 242/168 |
| 3,667,386 | 6/1972 | Workman | 100/233 |
| 5,230,282 | 7/1993 | Barnes | 100/34 |

FOREIGN PATENT DOCUMENTS

| | | | |
|---|---|---|---|
| 384370 | 2/1965 | Switzerland | 100/233 |
| 4285 | 1/1912 | United Kingdom | 242/537 |
| 1073781 | 6/1967 | United Kingdom | 242/537 |

*Primary Examiner*—Stephen F. Gerrity
*Attorney, Agent, or Firm*—Charles J. Prescott

[57] ABSTRACT

A collection and compacting apparatus for cardboard refuse such as flat pieces of cardboard and broken down or collapsed cardboard boxes and a uniquely shaped coil of flexible lashing for use with the apparatus for bundling the cardboard refuse. The apparatus, preferably wall mounted, includes a rigid support frame which defines a stationary upright surface and a lower horizontal support surface extending from a lower portion or margin of the stationary surface. A movable platen defines a flat cardboard refuse crushing surface and is pivotally connected at a lower end thereof to the horizontal support surface about an axis spaced from and parallel to the stationary surface. After the storage space defined by, and lying within, the stationary and crushing surfaces and the horizontal support surface is filled with cardboard refuse gathered in upright side-by-side orientation and supported edgewise atop the horizontal support surface, the movable platen is manually forcibly pivoted from its inclined collection position wherein the upper margin of the platen is further from the stationary surface than is the pivot axis to a generally upright compaction position. While the platen is held in this compaction position, either manually or by a releasible retainer, the compressed cardboard may be lashed into a bundle. Two coils of preferably uniquely shaped flexible lashing material or twine are positioned within the support frame behind the stationary surface to facilitate expedient bundling.,

8 Claims, 3 Drawing Sheets

CARDBOARD COLLECTOR AND COMPACTOR

BACKGROUND OF THE INVENTION

1. Scope of Invention

This invention relates generally to collection and disposal of cardboard refuse, and more particularly to a manually operated apparatus for collecting and facilitating bundling of compressed cardboard refuse such as flat pieces of cardboard and collapsed cardboard boxes.

2. Prior Art

The world, and particularly the industrial world, has become considerably more interested in preserving our environment and in the recycling of various forms of refuse, rather than simply creating huge mountains or landfills of such refuse adjacent urban areas for long-term decay. Not only are important natural resources of the world being depleted, but the long-term effects of decaying refuse heaps are impacting upon these urban areas as they grow.

One such recyclable material is in the form of cardboard formed from relatively stiff corrugated paper stock material. Such cardboard refuse may be in the form of either flat pieces of cardboard or cardboard boxes which are easily collapsed or knocked down into a flattened configuration. This cardboard refuse is highly recyclable, thus not only conserving trees as our source of paper, but also substantially reducing environmental pollution during the burning of cardboard as an alternative to refuse landfill decay.

Dealing with the collection and removal of flat pieces of cardboard and collapsed cardboard boxes, however, is not an easy task. Typically, stacks of such cardboard refuse are piled high and then, when of sufficient height, the cardboard refuse is then bundled by lashing or banding the material for removal. Considerable floor space is required and such stacks are typically messy, requiring straightening and alignment of cardboard edges prior to bundling. Additionally, the lifting and removal of a cardboard bundle laying flat atop the ground is difficult when done by one person.

Applicant is aware of a manual refuse compactor apparatus disclosed in U.S. Pat. No. 5,218,904 and invented by Loveland. This patent teaches a compact home-sized refuse compactor having spaced stationary and movable horizontally disposed platens. However, this arrangement is not well suited for the collection and bundling of cardboard refuse and requires excessive floor space.

The present invention provides a preferably wall-mountable apparatus for collecting cardboard refuse therewithin stacked edgewise on a regular or daily basis until such time as the storage space defined by the invention becomes full. At that time, a movable platen is manually forced against the cardboard refuse to compress and hold same until the compressed cardboard refuse is lashed together into a bundle for manual removal.

BRIEF SUMMARY OF THE INVENTION

This invention is directed to a collection and compacting apparatus for cardboard refuse such as flat pieces of cardboard and broken down or collapsed cardboard boxes and a uniquely shaped coil of flexible lashing for use therewith in bundling. The apparatus, which is preferably wall mounted, includes a rigid support frame defining a stationary upright surface and a lower horizontal support surface extending from a lower portion or margin of the stationary surface. A movable platen, which defines a flat cardboard refuse crushing surface, is pivotally connected at a lower end thereof to the horizontal support surface about an axis spaced from and parallel to the stationary surface. After the storage space defined by, and lying within, the stationary and crushing surfaces and the horizontal support surface is filled with cardboard refuse, the movable platen is manually forcibly pivoted from its inclined collection position wherein the upper margin of the platen is further from the stationary surface than is the pivot axis to a generally upright compaction position. While the platen is held in this compaction position, either manually or by releasible retention means, the compressed cardboard may be lashed into a bundle. Two coils of preferably uniquely shaped flexible lashing or twine are positioned within the support frame behind the stationary surface to facilitate expedient bundling.

It is therefore an object of this invention to provide an economically manufactured and compact apparatus for the collection, binding and removal of cardboard refuse such as flat pieces of cardboard and collapsed cardboard boxes.

It is another object of this invention to provide an economical means for collecting and binding cardboard refuse for recycling.

It is still another object of this invention to provide an apparatus for the orderly collection and binding into compressed bundles of cardboard refuse for recycling.

It is yet another object of this invention to provide an apparatus for use in homes, businesses, garages and the like for the orderly collection, binding and removal of cardboard refuse.

By being easily installable onto an interior wall of a building, the present invention also provides for the collection and bundling of cardboard refuse without the need for manual removal of pieces of cardboard to an outside refuse dumpster.

In accordance with these and other objects which will become apparent hereinafter, the instant invention will now be described with reference to the accompanying drawings.

DETAILED DESCRIPTION OF THE INVENTION

Figure 6:
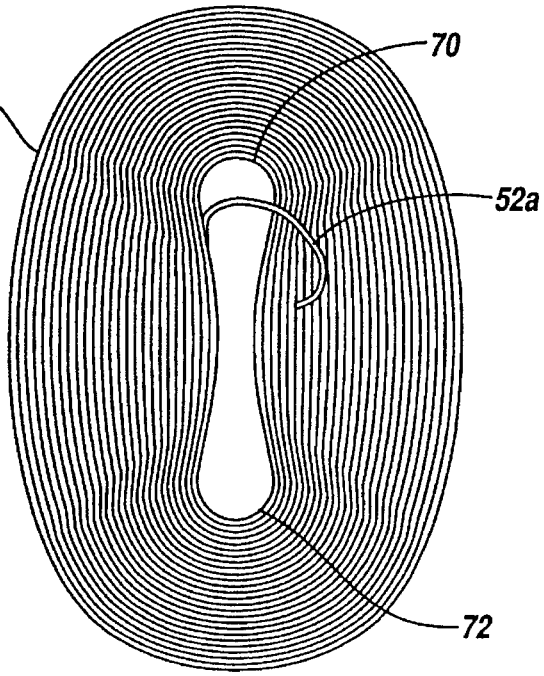
FIG. 6 is a plan view of a coil of lashing material for use with the invention in bundling cardboard refuse collected therewithin.

Referring now to the drawings, and particularly to FIGS. 1 to 5, the preferred embodiment of shown generally at numeral 10 and includes a rigid support frame 12, a rigid movable platen 30, and two coils of very long lashing material or twine as best seen in FIG. 6. The support frame 12 is fabricated of rigid tubular material having spaced upright members 14 and 16 held together by cross members 22 and 24. Each of the upright members 14 and 16 are arcuately bent at a lower mid portion thereof to define horizontal supports 18 and 20. Another cross member 26 ties the ends of members 18 and 20 together.

Figure 1:
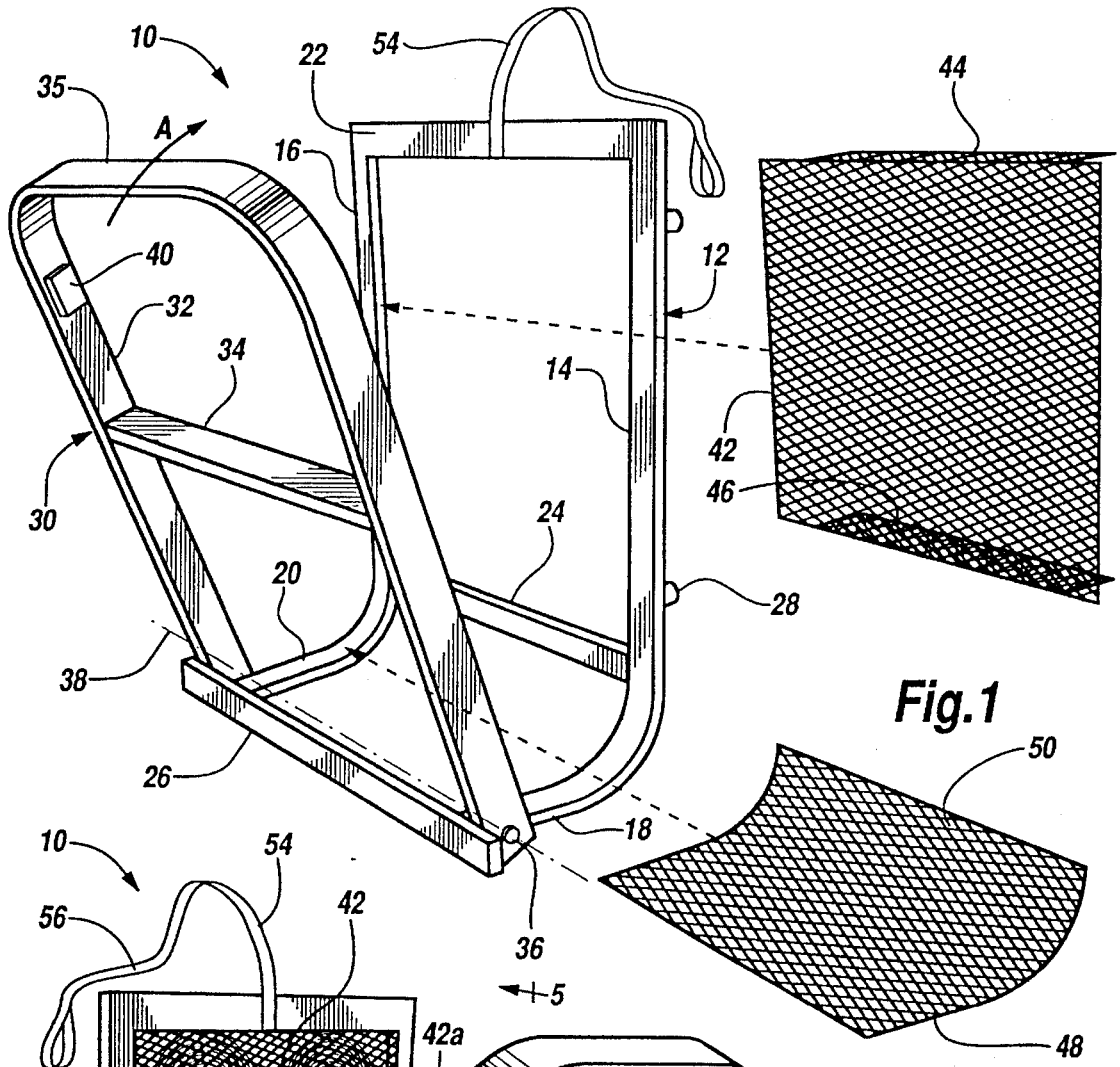
FIG. 1 is an exploded perspective view of the invention.
Figure 2:
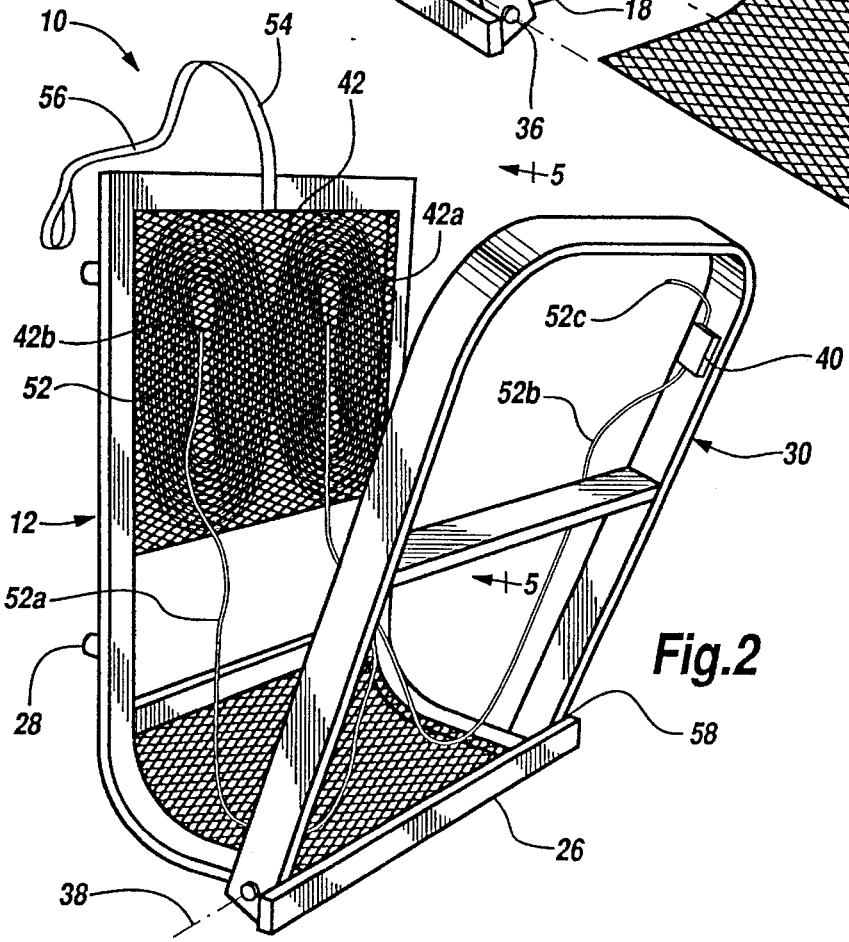
FIG. 2 is a perspective view of the assembled invention of FIG. 1.

The support frame 12 also includes an upright expanded metal or wire mesh panel 42 held in an upper position best seen in FIG. 2 to define, in combination with members 14 and 16, an upright stationary surface. A second expanded metal or wire mesh panel 48 having a curved flange 50 is connected atop members 18 and 20, again best seen in FIG. 2, to define a horizontal support surface.

The movable platen 30 is formed of an inverted generally U-shaped tubular member defining an upper horizontal handle 35 and downwardly extending legs held rigidly in the position shown by cross member 34. The lower ends of the movable platen 30 are pivotally connected by bolts 36 (typ.) to adjacent the ends of members 18 and 20 and immediately adjacent cross member 26. Thus, the movable platen 30 is pivotable in the direction of arrow A about horizontal pivotal axis 38 from its open collection position shown in FIGS. 1 and 2 wherein the lower edges of the movable platen 36 contact and rest against cross member 26 at 58.

Figure 3:
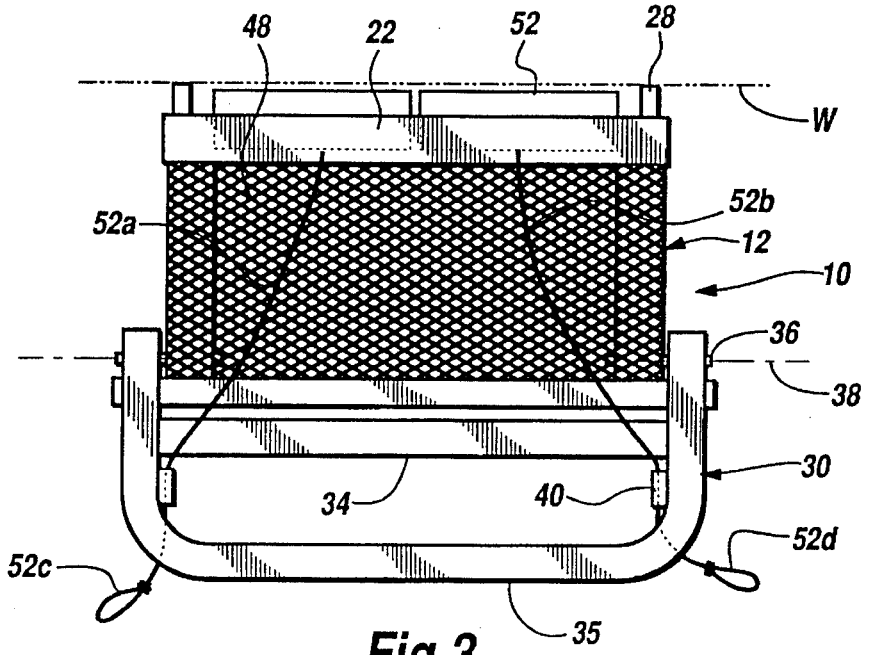
FIG. 3 is a top plan view of FIG. 2.
Figure 4:
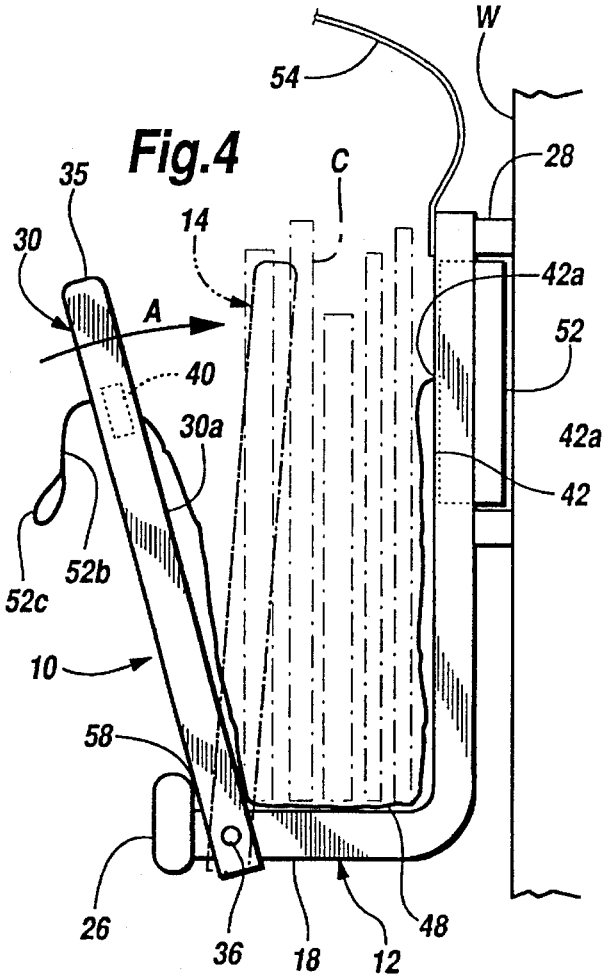
FIG. 4 is a right side elevation view of FIG. 1.
Figure 5:
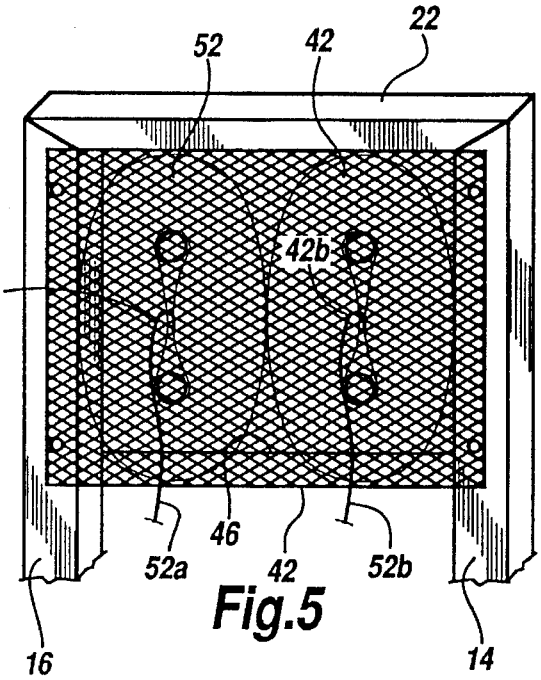
FIG. 5 is a view in the direction of arrows 5—5 in FIG. 2.

The apparatus 10, through its support frame 12, is preferably connectable to an upright wall surface W as seen in FIGS. 3 and 4 by mounting legs 28 (typ.) and suitable fasteners or anchors (not shown). The apparatus 10 is thus wall mountable with the horizontal surface defined by wire mesh panel 48 slightly above the floor surface, perhaps in the range of 6 to 10 inches.

Referring particularly to FIG. 4, the invention 10 is shown in its open or collection orientation wherein the movable platen 30 is resting against cross member 26 by contact at 58. In this collection position, the movable platen 30 is inclined away from the upright plane of the support frame defined in part by wire mesh panel 42 so that the upper handle 35 is further from the support frame 12 than is the pivotal axis 38. Pieces of flat cardboard and collapsed cardboard boxes shown typically at C in phantom are collected in side-by-side upright orientation with one (a lower) edge thereof resting atop at panel 48 as shown.

When sufficient pieces of cardboard refuse C have been gathered into the storage space defined between a lower portion of a crushing surface 30*a* defined by movable platen 30 and the upright stationary surface defined by support frame 12, this collection of cardboard refuse C is then ready to be bundled. At that time, the movable platen 30 is pivoted forcibly in the direction of arrow A to the generally upright position shown in phantom in FIG. 4, whereupon the cardboard refuse C is tightly manually compressed by the force exerted through handle 35 by the operator. At this point, the compressed bundle of cardboard refuse C may be bound together in a conventional manner.

Alternately, the present invention in its preferred embodiment 10 also includes convenient lashing means for use in bundling each compressed collection of cardboard refuse C. Two coils of preferably biodegradeable lashing material or twine 52 formed of ⅛ inch diameter sisal hemp are positioned in adjacent orientation between the wire mesh panel 42 and the wall W or other suitable surface to which the device 10 is connected. These coils 52 are supported by flange 46 of wire mesh panel 42. The free ends 52*a* and 52*b* of each coil 52 extend out through the wire mesh panel 42 at 42*a* and 42*b* and downwardly as best seen in FIG. 4 along the upright surface of the support frame 12, then horizontally across the panel 48, and then upwardly along the movable platen 30 for releasible engagement into rope locks 40. The very ends 52*c* and 52*d* of the lashing material are looped and knotted as shown.

Additional lashing material 52*a* and 52*b* is automatically withdrawn from the coils 52*a* as cardboard refuse C is gathered within the device 10. In fact, the lashing material actually stabilizes the first few pieces of cardboard uprightly by forming a "V" that is formed by the twine. When the storage space is filled and the movable platen 30 has been forcibly urged generally into its position shown in phantom in FIG. 4, each piece of lashing material 52*a* and 52*b* is then severed from the coils 52 and passed through the corresponding knotted loops 52*c* and 52*d*, respectively, after their removal from rope blocks 40. The free ends are drawn tightly around the cardboard refuse bundle and appropriately knotted. Thereafter, the lashed bundle is easily lifted and removed.

To hold the movable platen 30 in its forcibly urged compressing orientation against the cardboard refuse C, an elongated strap 54, connected at one end thereof to the cross member 22, may be extended over the top of the cardboard bundle to be engaged around handle 35 and then drawn back and locked upon itself by conventional two-part hook and loop materials appropriately positioned and connected to the strap 54.

Figure 7:
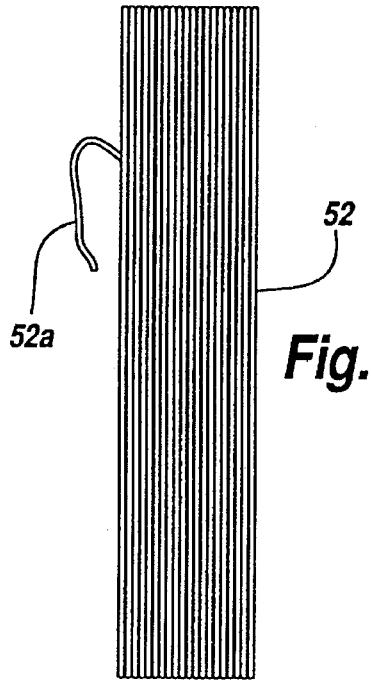
FIG. 7 is a side elevation view of FIG. 6.
Figure 8:
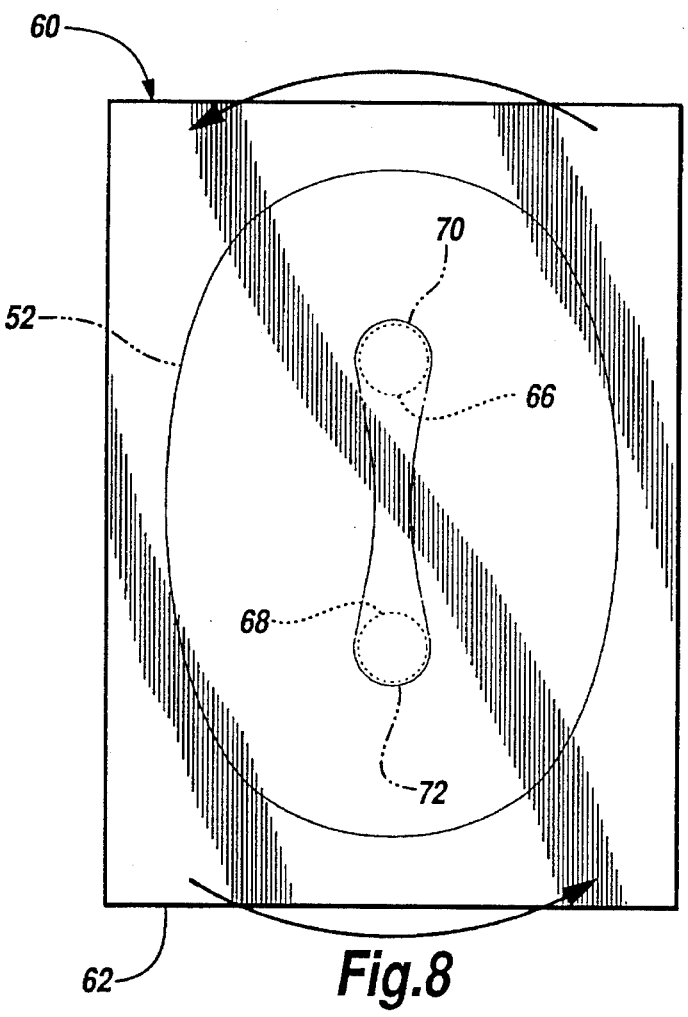
FIG. 8 is a plan view of a device for preparing the lashing coil shown in FIG. 6.
Figure 9:
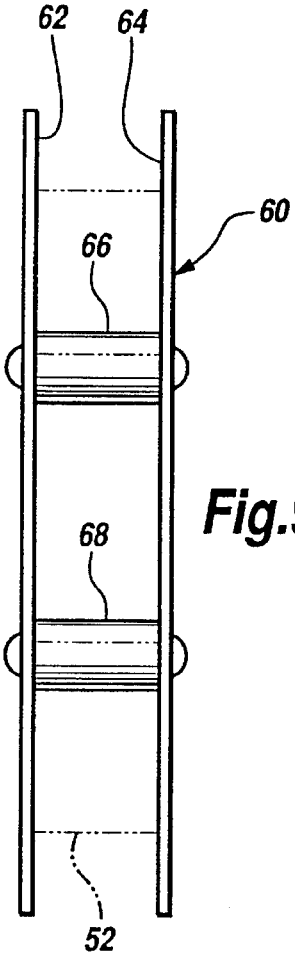
FIG. 9 is a side elevation view of FIG. 8.

The present invention is particularly conveniently operable when utilizing the uniquely configured coils of lashing material or twine 52 as best seen in FIGS. 6 and 7. The plan view configuration of each coil 52 is generally oval having flat side surfaces and a thickness as seen in FIG. 7 to be considerably smaller than either the width or the length of the coil 52 in FIG. 6. Two voids 70 and 72 are formed through each coil 52 centrally spaced along an imaginary longitudinal axis of each coil. These voids 70 and 72 are formed when the coil itself is formed by the device shown in FIGS. 8 and 9. This coil forming device 60 is in the form of two spaced flat plates 62 and 64 releasibly connected by winding rods or shafts 66 and 68. After one end of a very long length of lashing material has been tied around one of the winding rods 66 or 68, either the device 60 is rotated as in the direction of the arrows or the lashing length is wound around rods 66 and 68 and gathered to form the coil 52 of desired material length and overall size. After the lashing material has been wound around winding rods 66 and 68 between plates 62 and 64, the coiling device 60 is disassembled and the coil 52 removed. When wound sufficiently tightly, the coil 52 is thus self-sustaining in overall shape for installation into the apparatus 10 in the position previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A manual cardboard refuse collector and compactor apparatus comprising:

a support frame defining a stationary upright surface and a generally horizontal support panel extending laterally from a lower portion of said upright surface for catching smaller pieces of cardboard refuse;

a movable platen having a free upper distal end and pivotally connected at a lower end thereof to said horizontal support panel about a horizontal pivot axis spaced from and generally parallel to said stationary surface a distance generally equal to a thickness of a typical bundle of cardboard refuse;

said movable platen defining a cardboard crushing surface spaced opposingly to said stationary upright surface;

an upright storage space defined by said moveable platen, said stationary upright surface and said horizontal support panel for collecting flattened cardboard refuse in close side-by-side arrangement edgewise atop said horizontal surface;

said platen movable pivotally about said axis between a collection position wherein said crushing surface is inclined away from said upright surface for cardboard refuse collection therebetween and a compaction position wherein, when said storage space is filled with cardboard refuse, said crushing surface is forcibly manually urged to a generally upright orientation to tightly compress the cardboard refuse between said crushing and stationary surfaces in preparation for bundling the cardboard refuse.

2. A cardboard collector and compactor as set forth in claim 1, further comprising:

flexible means for releasibly holding said platen in the compacting position during cardboard refuse bundling.

3. A cardboard collector and compactor as set forth in claim 1, further comprising:

a coil of flexible lashing material replaceably held within said support frame such that a free end of said coil may be extended from a central point of said support surface for use in bundling the cardboard refuse.

4. A cardboard collector and compactor as set forth in claim 3, further comprising:

means for connecting said support frame to an upright supporting wall wherein said coil is sized for, and positioned between, said stationary surface and the wall.

5. A cardboard collector and compactor as set forth in claim 4, further comprising:

means for releasibly securing the free end of said coil to said support frame.

6. A cardboard collector and compactor as set forth in claim 3, said coil having a shape comprising:

an outer plan perimeter of generally oval configuration;

parallel flat side surfaces spaced apart to define a thickness of said coil; and two spaced voids through the thickness of said coil and positioned centrally along a longitudinal center line of said coil, said voids formed by two spaced winding rods used to form said coil.

7. A coil of a very elongated length of flexible lashing for use with a manual cardboard refuse collector and compactor apparatus, said apparatus including:

a support frame defining a stationary upright surface and a generally horizontal support surface extending laterally from a lower portion of said upright surface;

a movable platen pivotally connected at a lower end thereof to said horizontal support surface about a horizontal pivot axis spaced from and generally parallel to said stationary surface;

said movable platen defining a cardboard crushing surface spaced opposingly to said stationary upright surface to define, in cooperation with said horizontal support surface, an upright storage space for receiving cardboard refuse including cardboard and collapsed cardboard boxes placed within said storage space in close side-by-side arrangement edgewise atop said horizontal support surface;

said platen movable pivotally about said axis between a collection position wherein said crushing surface is inclined away from said upright surface for cardboard refuse collection therebetween and a compaction position wherein, when said storage space is filled with cardboard refuse, said crushing surface is forcibly manually urged to a generally upright orientation to tightly compress the cardboard refuse between said crushing and stationary surfaces in preparation for bundling the cardboard refuse;

said coil held within said support frame such that a free end of each said coil extends from a central point of said support surface for use in bundling the cardboard refuse, said coil having a shape comprising:

an outer plan perimeter of generally oval configuration;

parallel flat side surfaces spaced apart to define a thickness of said coil; and two spaced voids through the thickness of said coil and positioned centrally along a longitudinal center line of said coil, said voids formed by two spaced winding rods used to form said coil.

8. A manual cardboard refuse collector and compactor apparatus consisting essentially of:

a support frame defining a stationary upright surface and a generally horizontal support surface extending laterally from a lower portion of said upright surface for catching smaller pieces of cardboard refuse;

a movable platen having a free upper distal end and pivotally connected at a lower end thereof to said horizontal support surface about a horizontal pivot axis spaced from and generally parallel to said stationary surface a distance generally equal to the thickness of a typical bundle of cardboard refuse;

said movable platen defining a cardboard crushing surface spaced opposingly to said stationary upright surface;

an upright storage space defined by said moveable platen, said stationary upright surface and said horizontal support surface for collecting flattened cardboard refuse in close side-by-side arrangement edgewise atop said horizontal surface;

said platen movable pivotally about said axis between a collection position wherein said crushing surface is inclined away from said upright surface for cardboard refuse collection therebetween and a compaction position wherein, when said storage space is filled with cardboard refuse, said crushing surface is forcibly manually urged to a generally upright orientation to tightly compress the cardboard refuse between said crushing and stationary surfaces in preparation for bundling the cardboard refuse.

* * * * *